US005448533A

United States Patent [19]

Owen

[11] Patent Number: 5,448,533

[45] Date of Patent: Sep. 5, 1995

[54] METHOD AND APPARATUS FOR ACCURATE TIME MAINTENANCE AND DISPLAY

[75] Inventor: Jeffrey R. Owen, Portland, Oreg.

[73] Assignees: Seiko Corporation; Seiko Epson Corporation, both of Japan

[21] Appl. No.: 179,835

[22] Filed: Jan. 7, 1994

Related U.S. Application Data

[63] Continuation of Ser. No. 512,237, Apr. 18, 1990, abandoned.

[51] Int. Cl.[6] ..... G04C 11/02

[52] U.S. Cl. ..... 368/47; 368/55

[58] Field of Search ..... 368/41-56

[56] References Cited

U.S. PATENT DOCUMENTS

| | | | |
|---|---|---|---|
| 4,582,434 | 4/1986 | Plangger et al. | 368/47 |
| 4,650,344 | 3/1987 | Allgaier et al. | 368/47 |
| 4,768,178 | 8/1988 | Conklin et al. | 368/47 |
| 4,823,328 | 4/1989 | Conklin et al. | 368/47 |

*Primary Examiner*—Bernard Roskoski
*Attorney, Agent, or Firm*—Elmer Galbi

[57] ABSTRACT

A highly accurate time keeping device and time keeping system are disclosed. Time of day information is periodically sent to a wristwatch via radio signal. The time of day as displayed by the watch is updated periodically using the radio signal data and maintained between such periodic updates according to an algorithm of the present invention. The disclosed time keeping system thereby maintains a plurality of time keeping devices in substantially exact synchronization over an extended period.

1 Claim, 7 Drawing Sheets

METHOD AND APPARATUS FOR ACCURATE TIME MAINTENANCE AND DISPLAY

This application is a continuation of application Ser. No. 07/512,237, filed Apr. 18, 1990 which is now abandoned.

FIELD OF THE INVENTION

The present invention relates to time keeping and more particularly to a radio controlled time keeping apparatus.

BACKGROUND OF THE INVENTION

For expository convenience the present invention will be illustrated with reference to a paging system (the "Gaskill system") described in U.S. Pat. Nos. 4,713,808 and 4,897,835. However, it will be understood that the present invention is not so limited. The disclosures of U.S. Pat. Nos. 4,713,808 and 4,897,835 are incorporated herein by reference.

For purposes of the present discussion, it will be understood that the Gaskill system provides a paging system wherein a paging device is incorporated into a wristwatch. Paging information, together with time of day information, is transmitted by FM radio signal to each watch according to a time slot protocol. In accordance with this protocol, the watch includes a timing mechanism for activating a radio receiver and decoder of the watch during a time slot selected by the watch. The watch thereby activates its radio receiver and decoder to capture the radio signal data broadcast during its selected time slot.

A watch using the Gaskill system can maintain a higher degree of accuracy than a conventional time piece. For example, with a conventional time piece, even the slightest inaccuracy in its time keeping reference can be cumulative. The extent of error, or deviation from the actual time tends to grow over time. With a number of conventional time pieces placed side by side, the least significant digits, e.g., the seconds digits, will not change in synchronization. Even if conventional time pieces are set initially to identical time, the slightest inaccuracy in time keeping accumulates making impossible synchronized time displays.

Thus, inaccuracy of a time piece is observed by inspecting the time displayed by a number of such time pieces placed side by side. If the time pieces keep accurate time, this is reflected in simultaneous display updates by all time pieces. For example, the seconds display for all devices will change simultaneously if time is maintained accurately by all devices. Typically, however, such simultaneous display updating is not achieved, and if achieved such condition does not endure.

Accordingly, it is desirable to provide an accurate time keeping device whereby a group of such devices maintains time accurately and exhibits such accuracy by continued simultaneous display updating.

SUMMARY OF THE INVENTION

The present invention provides a highly accurate time keeping device and time keeping system wherein a plurality of watches can be maintained in exact synchronization over an extended period. With the present invention, time of day data is periodically received by, for example, a wristwatch via radio signal and the time maintained by the watch is updated using an algorithm of the present invention.

When a radio message which includes time of day data is received, the watch first enters a fixed execution time routine. At a fixed point in this routine the system reads a first value from a counter. The watch then enters a variable execution time routine, which does a variety of watch operations including setting the watch internal time. Internal time is set in accordance with the time of day data found in the radio message plus a time proportional to the difference between a second value read from the counter and the first value read from the counter.

In accordance with the present invention, each watch maintains the time of day by applying a clock signal generated from its internal time reference and of known frequency to a counter. By intermittently reading the contents of the counter, the elapsed time between such readings may be calculated. The calculated elapsed time is accumulated in a fractional second register and when that fractional second register exceeds a given value, that value is subtracted from the fractional second register and added to the time of day value held by the watch. Updating the watch time of day display is triggered by the fractional second register exceeding the given value. By referencing the contents of the fractional second register and causing the next reading of the counter to occur at a time such that the fractional register will next hold a desired target value, all watches can update their respective time of day displays substantially simultaneously.

BRIEF DESCRIPTION OF THE DRAWINGS

A complete understanding of the present invention may be obtained by reference to the accompanying drawings, when taken in conjunction with the detailed description thereof, and in which.

DETAILED DESCRIPTION OF THE PREFERRED EMBODIMENT

Figure 1:
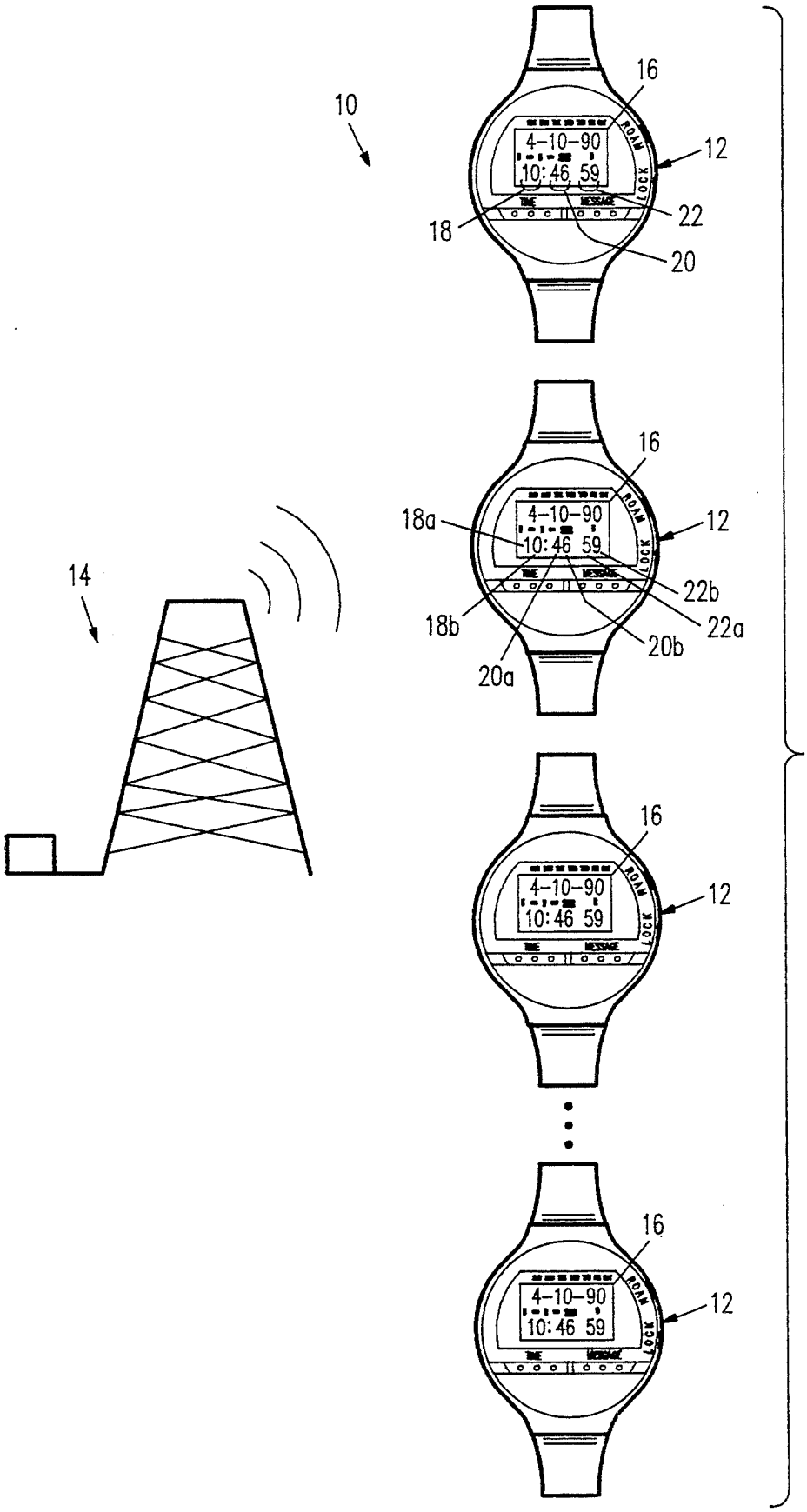
FIG. 1 illustrates a plurality of wristwatches, each for maintaining and displaying a time of day, and a radio broadcasting system for providing by radio signal time of day data to the watches.

FIG. 1 illustrates a preferred embodiment of a time keeping system 10 according to the present invention and including a radio signal broadcasting device 14 and a plurality of wristwatches 12. The time keeping system 10 is integrated into the Gaskill paging system described in U.S. Pat. Nos. 4,713,808 and 4,897,835. In the Gaskill paging system, radio signal broadcasting device 14 provides paging information to wristwatches 12 in accordance with a time slot protocol. Each wristwatch 12 is associated with one or more time slots in a repeating sequence of time slots. A data packet is broadcast during each time slot. Each wristwatch 12 is activated during its associated time slot, or slots, to receive paging information directed to it.

Radio signal broadcasting device 14 also provides current time of day data which aids in synchronization of the wristwatches 12 relative to the repeating sequence of time slots. This time of day data is used to periodically set the wristwatches 12 to the current time of day. Thus, all wristwatches 12 receiving radio signals broadcast by device 14 are periodically set relative to a common time standard. Between such periodic setting of wristwatches 12, each wristwatch 12 accurately maintains time to properly activate for a next associated time slot and to accurately display the time of day.

As used herein, and in the claims appended hereto, the term "time of day data" shall mean information referencing a time standard. For example, broadcasting device 14 can broadcast as part of certain data packets a set of time of day values, e.g., hours, minutes, seconds, and fractions of a second. Upon capture of the data packet, a current time of day coincident with capture of the packet may be defined as the time of day values found in the data packet, perhaps offset by a known factor taking into account fixed delays associated with bundling the data packet and transmitting the packet. Alternately, each data packet carries its time slot identification uniquely identifying the time slot within the repeating cycle of time slots. By capturing an arbitrary data packet, it is, therefore, possible to reference a time standard by identifying the associated time slot within the repeating cycle of time slots. A time of day may, therefore, be derived by use of the time slot identification. In either case, wristwatches 12, when using such time of day data found in captured data packets, each reference a common external time standard.

Each wristwatch 12 of time keeping system 10 includes a display 16 for presenting a current time of day. It will be appreciated that the time keeping accuracy of system 10 is exemplified by each display 16 not only presenting an identical time of day, but also by displays 16 changing simultaneously from one time of day display to the next.

For example, each wristwatch 12 presents the current time of day as a sequence of ordered digit pairs 18, 20, and 22 representing hours, minutes and seconds, respectively. Each of digit pairs 18, 20 and 22 include a high order tens digit indicated by a suffix "a" and a low order units digit indicated by the suffix "b". The least significant digit of the time of day as presented on each display 16 is lower order digit **22*b* representing the units digit of the seconds display. Accuracy of time keeping system 10 is reflected generally identical digit pairs 18, 20 and 22 on each display 16, and particularly by simultaneous change, within the limits perceivable to the human eye, in the digit 22*b* for all wristwatches 12**.

Figure 2:
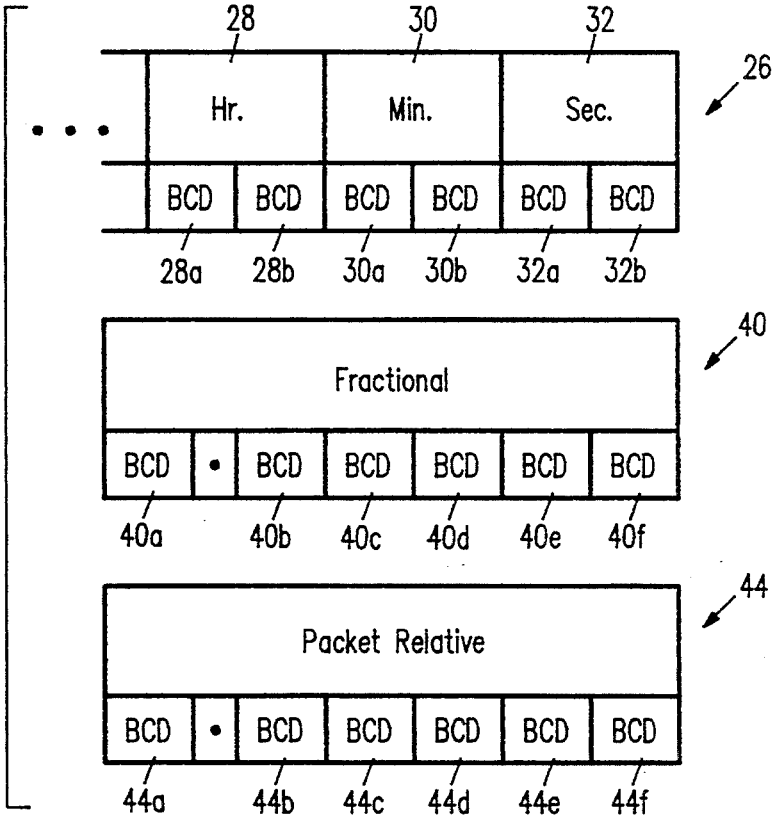
FIG. 2 illustrates registers maintained by each of the wristwatches of FIG. 1.

FIG. 2 illustrates memory registers used by wristwatch 12. Each wristwatch 12 includes a time of day register 26 for storing current time of day values. An hours register 28 of register 26 holds the hour digits **18*a* and 18*b* in binary coded decimal (BCD) registers 28*a* and 28*b*, respectively. A minutes register 30 holds in BCD registers 30*a* and 30*b* the minute digits 20*a* and 20*b*, respectively. Similarly, the second digits 22*a* and 22*b* are held in BCD registers 32*a* and 32*b*. Additional information stored in register 26 would include, for example, the day of week, day of month, month, and year. By accurately maintaining the time of day values held in register 26, wristwatch 12 accesses registers 28, 30 and 32 to drive digit pairs 18, 20 and 22, respectively of its display 16**.

A fractional register 40 stores a time value expressed in seconds. Register 40 comprises a units digit BCD register **40*a* for storing the number of whole seconds represented by register 40 and five BCD registers 40*b*–40*f* for storing a fractional portion of the seconds value represented by register 40. More particularly, BCD registers 40*b*–40*f* correspond to tenths, hundreds, thousands, tenths of thousandths and hundredths of thousandths, respectively, of a second. Thus, register 40 holds a BCD seconds time value expressed to a high degree of precision. A packet relative register 44, similar in structure to register 40, also holds a high precision seconds time value. Packet relative time register 44 contains a units digit BCD register 44*a* and five BCD registers 44*b*–44*f* for holding tenths, hundredths, thousandths, tenths of thousandths and hundredths of thousandths, respectively, of a second. Register 44 stores a value which is added to the time of day data found in data packets when setting the wristwatches 12** to the current time of day.

Figure 3:
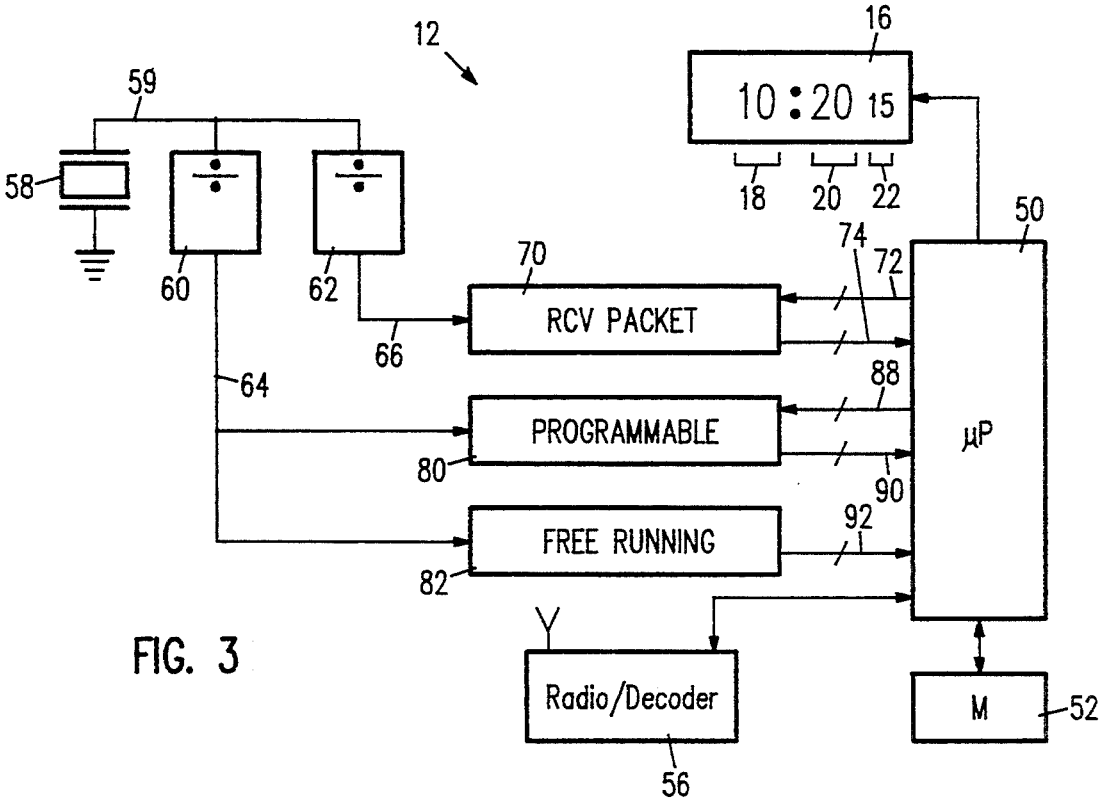
FIG. 3 is a simplified block diagram of the circuity of each of the wristwatches of FIG. 1 including a programmable micro-processor for controlling watch operations, a radio receiver section for receiving information provided by the broadcasting system of FIG. 1, timer devices used to control operation of the micro-processor, and a crystal based time reference.

FIG. 3 is a simplified block diagram of the circuitry of each wristwatch 12. Each wristwatch 12 includes a microprocessor 50 coupled to display 16 and adapted to suitably drive display 16 to present the time of day. A memory device 52 accessible to processor 50 includes ROM portions for storing an operating program and RAM portions, including registers 26, 40 and 44, for dynamic data. Processor 50 maintains the values held in registers 26, 40 and 44 accurately to reflect a current time of day, and accesses register 26 to obtain data for driving display 16.

The time of day held by wristwatch 12 at any given time is the sum of the elapsed time accounted for by counter 82, the value held in register 40, and the value held in time of day register 26.

A radio/decoder 56 of wristwatch 12 captures data packets provided by broadcasting device 14. It will be understood, in accordance with the Gaskill paging system, that processor 50 and radio/decoder 56 interact whereby processor 50 obtains from radio/decoder 56 the captured data packet. It will be further understood that radio/decoder 56 provides a packet detect signal to processor 50 indicating the time of data packet capture.

A quartz crystal 58 provides a 50 KHz timing signal 59 as a timing reference to divider circuits 60 and 62. Circuits 60 and 62 each divide the 50 KHz timing signal to provide clock signals 64 and 66, respectively, at desired frequencies.

Divider circuit 62 divides the timing signal 59 to provide clock signal 66 at a known frequency. Clock signal 66 drives RCV packet timer 70 whereby timer 70 counts at a known rate. In accordance with the Gaskill paging system, processor 50 programs timer 70 by writing a count value 72 into timer 70 to provide an interrupt signal 74 in anticipation of the next desired time slot. Thus, processor 50 determines when, by reference to the repeating cycle of time slots, the next desired time slot will occur and sets timer 70 to provide interrupt signal 74 in time to power-up radio/decoder 56 and capture a data packet broadcast during that time slot. The radio/decoder 56 may be programmed to monitor a selected broadcast frequency. Radio/decoder 56 provides the packet detect signal to processor 50 when a data packet is captured. Processor 50 later obtains this data packet from radio/decoder 56 for processing.

The data packet obtained from radio/decoder 56 contains paging information as well as time of day data. The time of day data is expressed to a high degree of precision, e.g., to one thousandth of a second, as this information is used to precisely synchronize wristwatch 12 with the repeating sequence of time slots.

Wristwatch 12 periodically uses the highly accurate time of day data to set registers 26 and 40. Wristwatch 12 can obtain such radio transmitted time of day data at any time as the process of capturing a data packet serves as reference to a time standard. Thus, wristwatch 12 can reset registers 26 and 40 as often as every few minutes, or every few days. In practice, activation for the purpose of resetting registers 26 and 40 should be weighed against the associated cost in battery life. Setting registers 26 and 40 approximately every hour is considered suitable.

Divider circuit 60 divides the timing signal 59 to provide clock signal 64 at a known frequency. Clock signal 64 then drives both a programmable timer 80 and a free running counter 82. Timer 80 and free running counter 82 allow processor 50 to maintain time between the periodic resetting of registers 26 and 40.

Figure 4:
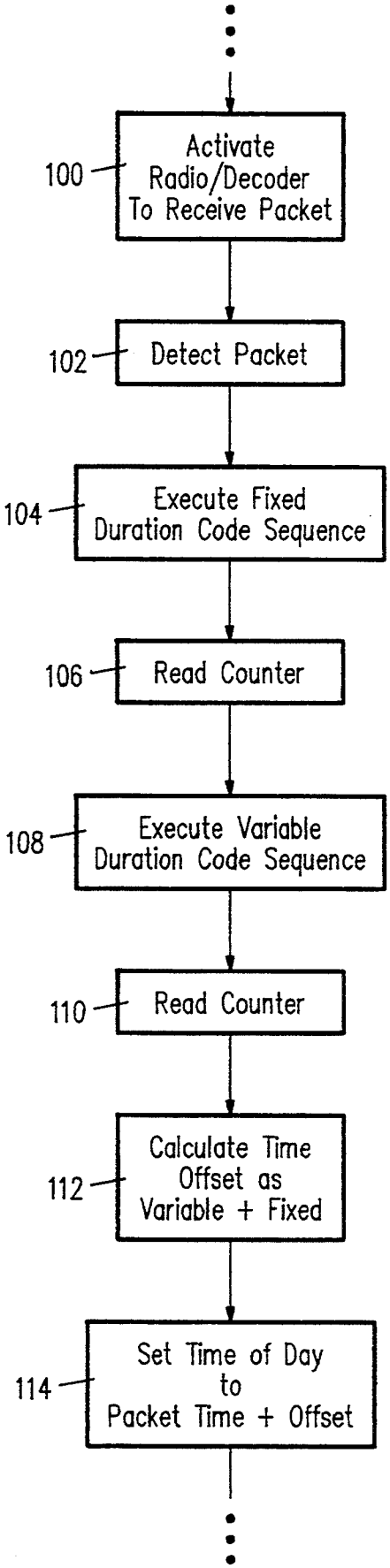
FIG. 4 is a flow chart illustrating program steps used by the micro-processor of FIG. 3 for receiving time of day data by radio signal.

Processor 50 writes a calculated count value 88 into programmable timer 80 and timer 80 later responds with an interrupt signal 90 when this count has elapsed. Processor 50 responds to interrupt signal 90 by reading a count value 92 from counter 82 and calculating the elapsed time between occurrences of interrupt signal 90 by comparing the current count value 92 to a previously read count value 92. By suitably programming timer 80, processor 50 intermittently reads counter 82 and determines elapsed time between such reading of counter 82. The elapsed time value is then applied to the fractional register 40 and the packet relative register 44. The process of applying elapsed time to registers 40 and 44 typically occurs once every second but may occur more often. When the value held by fractional register 40 exceeds one second, fractional register 40 is decremented by one second and the time of day register 26 is incremented by one second. Processor 50 thereby accounts for time in the intervening period between receiving time of day data by radio signal from broadcasting device 14. FIG. 4 is a flow chart illustrating generally the procedures employed by wristwatch 12, as by programming of processor 50, for setting the time of day register 26 and fractional register 40 in response to time of day data obtain by radio signal from broadcasting device 14. With reference to FIG. 4 in conjunction with FIG. 3, processing begins in block 100 where processor 50 activates radio/decoder 56 in anticipation of a particular time slot selected by wristwatch 12. Radio/decoder 56 then monitors a selected radio frequency for a data packet. Upon successfully capturing a data packet, radio/decoder 56 so informs processor 50 by way of the packet detect signal as indicated by detecting a packet in block 102. Processor 50 then commences execution of a sequence of program code of substantially fixed duration, represented by block 104.

The time of day data contained in the data packet captured by radio/decoder 56 is not immediately available to processor 50. Processor 50 executes many wristwatch 12 functions and cannot immediately apply the radio transmitted time of day data to registers 26 and 40. Higher priority tasks may require execution first. Accordingly, processor 50 necessarily executes such high priority program code sequences before actually processing the data packet to obtain the time of day information contained therein. In spite of an operating system first executing such high priority program code segments, it is still possible for processor 50 to accurately set the time of day register 26 and fractional register 40 at an arbitrary time following the capture of the data packet.

Since packets are transmitted at known times, the detection of a packet in block 102 serves as a time reference relative to the time of day data contained in the data packet. Execution of the fixed duration code sequence of block 104 represents a substantially fixed time offset from detection of the packet in block 102. Following execution of block 104, processor 50 reads counter 82 in block 106 to obtain a time reference relative to the detection of the packet in block 102. Processing then continues through block 108, a sequence of program code of variable duration, and on to block 110 where processor 50 again reads counter 82. In block 108, processor 50 performs, among other tasks, the task of obtaining from radio/decoder 56 the time of day data contained within the captured packet. Having read counter 82 before and after block 108, processor 50 has sufficient information to measure the execution time of block 108.

Given the known execution time of blocks 104, 106 and 110 and the measured execution time of block 108, processor 50 can calculate in block 112 an offset to be applied to the time of day data contained in the captured data packet. Such offset, including a fixed value and a measured variable value, accounts the period of time between the reception of the data packet and execution of block 114 where processor sets registers 26 and 40. Therefore, processor 50 need not immediately process the captured data packet. Processor 50 is free to service other high priority wristwatch 12 functions before setting the registers 26 and 40 in response to the radio transmitted time of day data.

Figure 5:
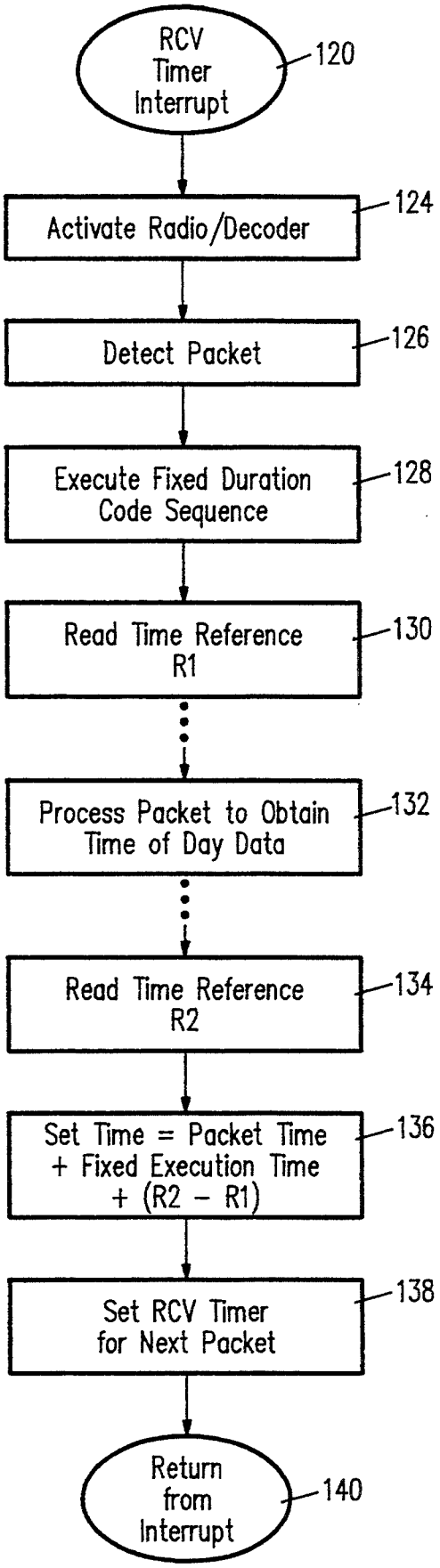
FIG. 5 is a flow chart of an interrupt driven routine used by the micro-processor of FIG. 3 for receiving time of day data by radio signal.

With reference to FIG. 5 in conjunction with FIG. 3, FIG. 5 illustrates in more detail the process of setting registers 26 and 40 in response to the radio transmitted time of day data provided by broadcasting device 14. More particularly, FIG. 5 illustrates an interrupt routine responsive to interrupt signal 74 to drive operation of processor 50.

In block 120 processor 50 has received interrupt signal 74. Processor 50 then activates radio/decoder 56 in block 124 and waits in block 126 for a packet detect signal from radio/decoder 56. Upon receiving the packet detect signal from radio/decoder 56, processor 50 executes in block 128 a substantially fixed execution time code sequence. In block 130, just following completion of block 128, processor 50 reads counter 82 to obtain a time reference R1 and proceeds with a program code sequence of variable execution time, including block 132 wherein processor 50 obtains from radio/decoder 56 the captured data packet and from the captured data packet the time of day data contained in the data packet.

Upon completing the variable execution time code sequence, processor 50 reads counter 82 in block 134 to obtain a second time reference R2. The second reading of counter 82 provides a measure, i.e., R2–R1, of the execution time of the variable execution time code sequence. Wristwatch 12 is then set in block 136 using the time of day data found in the captured data packet plus the sum of the fixed execution time and measured execution time. In particular, processor 50 sets registers 26 and 40 in accordance with the time of day data found in the captured data packet. Processing continues to block 138 where processor 50 calculates an offset for the next selected time slot and sets the RCV packet timer 70 for a corresponding delay. Processor 50 then returns from the interrupt signal 74 routine in block 140.

Processor 50 periodically receives interrupt signal 74 and can respond by applying the time of day data obtained from the captured data packet to the registers 26 and 40. It should be understood that the steps illustrated in FIG. 5 illustrate those taken for the purpose of setting registers 26 and 40, and that processor 50 does not always capture a data packet for this purpose.

Figure 6:
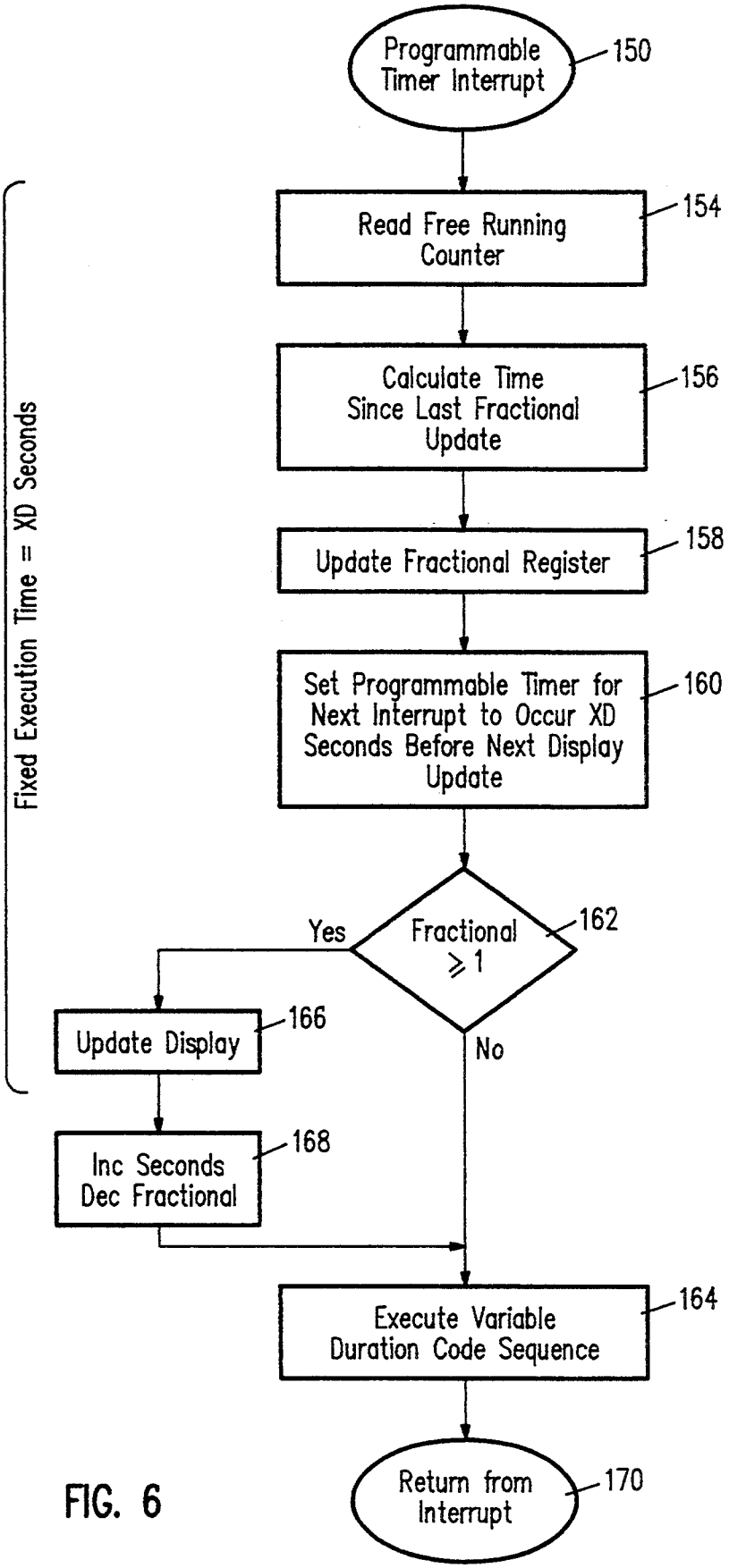
FIG. 6 is a flow chart of an interrupt driven routine used by the micro-processor of FIG. 3 for maintaining the time of day and updating the time of day display.

FIG. 6 illustrates generally the procedures employed, by suitable programming of processor 50, in response to interrupt signal 90 for maintaining and displaying the current time of day on display 16. With reference to FIG. 6 together with FIG. 3, the signal 90 interrupt procedure accepts the time of day information held in registers 26 and 40 as being correct. The procedure maintains those time of day values in the period between their setting in response to time of day data obtained by radio signal. Generally, processor 50 programs timer 80 to intermittently provide interrupt signal 90 and in response processor 50 reads counter 82. Each time processor 50 reads counter 82 it stores the count value 92 obtained for comparison to the next count value 92 obtained in order to measure the time interval between such readings as a multiple of the period of clock signal 64. Therefore, in the following description it will be assumed that processor 50 has previously read counter 82 and stored the count value 92 then obtained.

Processing begins in block 150 with processor 50 responding to interrupt signal 90. Processing advances to block 154 where processor 50 reads counter 82. Continuing to block 156, processor 50 compares the new, or current, count value 92 to the old, or last, count value 92 obtained. The elapsed time since the last reading of counter 82 is calculated as the current count value 92 minus the last count value 92 multiplied by the period of clock signal 64. The calculated elapsed time is added to fractional register 40 in block 158.

As explained in greater detail hereafter, programmable timer 80 is then set in block 160 such that the next occurrence of interrupt signal 90 will produce a given target value in register 40 as a result of the addition performed in block 158. In decision block 162 processor 50 compares the value held in register 40 to the value one. If register 40 holds a value less than one, then processing continues to block 164 where processor 50 executes any variable duration watch functions, e.g., watch button functions, and then returns from the interrupt signal 90 routine in block 170.

If, however, processor 50 determines in block 162 that register 40 holds a value equal to or greater than one, then processing branches to block 166. In block 166 processor 50 applies the current value of register 26 to display 16 in order to update display 16. Continuing to block 168, processor 50 decrements register 40 by one and increments BCD register **32*b* by one. It will be understood that upon incrementing the seconds digit 32*b*, additional changes to register 26 may be necessary. For example, when digit 32*b* goes from the value nine to the value zero, tens of seconds digit 32*a* is incremented by the value one. Similar changes may propagate through register 26 in convention fashion. Once register 26 is suitably incremented, processing continues to block 164 as described above. Thus, time maintained by counter 82 between assertions of interrupt 90 is transferred to fractional register 40, and then transferred to time of day register 26** in whole seconds units.

The execution time of blocks 150–162 and 166 is a substantially fixed execution time XD. In programming timer 80 in block 160, processor 50 references the current value of register 40 and the known execution time XD in order to cause the next display update in block 166 to occur when fractional register 40 contains a given target value. Because all wristwatches 12 target the same value for register 40, all wristwatches 12 execute block 168 at substantially the same time and therefore change from one time display to the next in synchronization.

Figure 7:
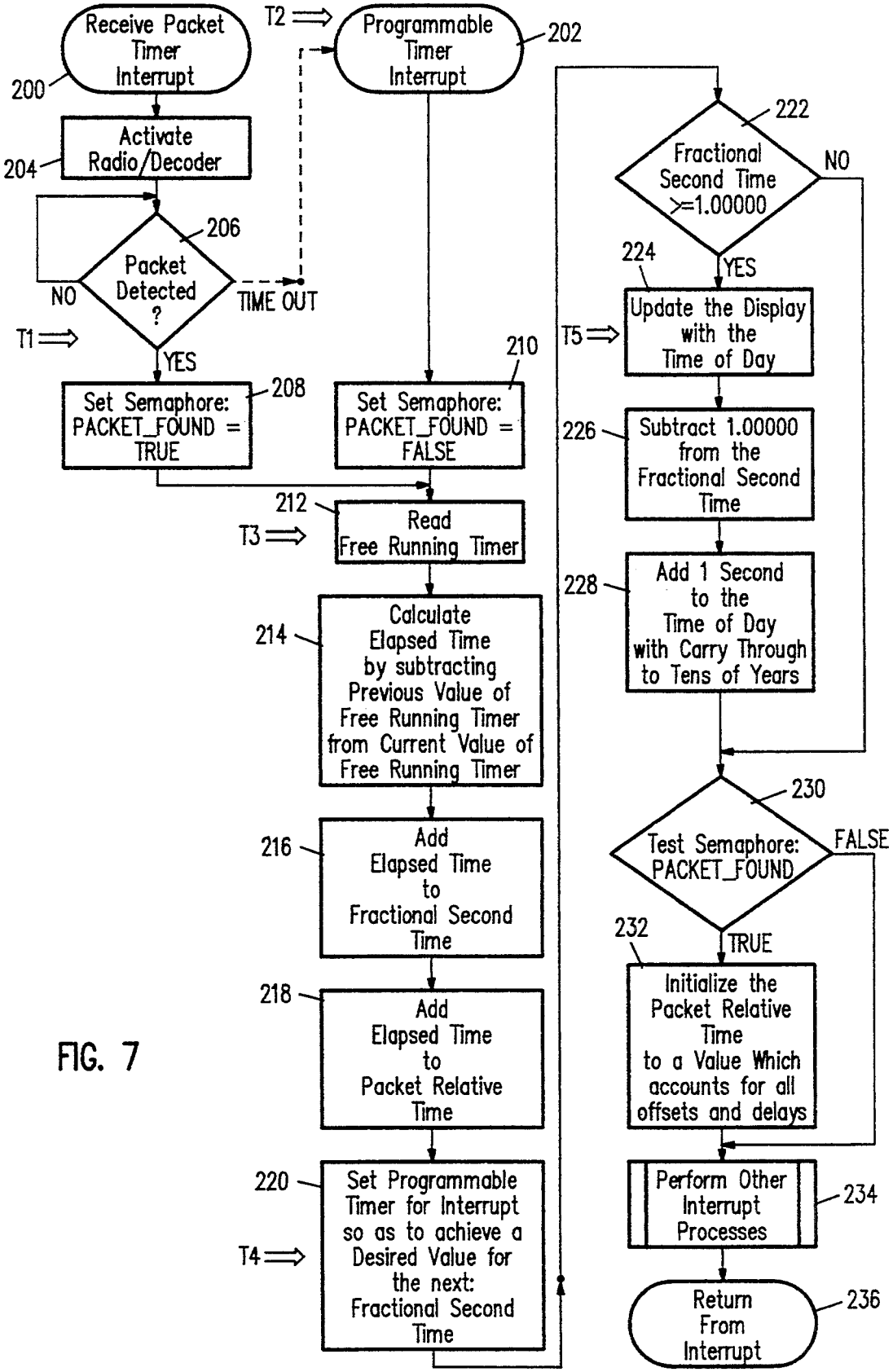
FIG. 7 is a flow chart of an interrupt driven routine incorporating the features of the programs illustrated in FIGS. 4–6.

By selecting a target value for register 40 that is a few hundredths of a second greater than one, slight timing errors are not likely to affect the outcome of comparing the contents of register 40 to the value one. FIG. 7 is a flow chart of an interrupt driven routine incorporating the steps shown in FIGS. 4–6, and responsive to both interrupt signals 74 and 90. With reference to FIGS. 3 and 7, block 200 represents an entry point corresponding to assertion of interrupt signal 74 and block 202 is an entry point for interrupt signal 90.

When interrupt signal 74 is asserted, for the purpose of capturing a data packet, processing begins in block 204 where processor 50 activates radio/decoder 56. Processor 50 then loops at decision block 206 until receiving the packet detect signal from radio/decoder 56. Before entering the block 206 loop, however, processor 50 programs timer 80 to provide interrupt signal 90 and vector execution to block 202 in the event that radio/decoder 56 is unsuccessful in capturing a data packet and, therefore fails to bring processor 50 out of the block 206 loop. When radio/decoder 56 does capture a data packet and provides the packet detect signal to processor 50, processor 50 sets in block 208 a semaphore PACKET_FOUND to true.

When interrupt signal 90 is asserted, processing begins in block 210 where processor 50 sets the semaphore $PACKET_{13}$ FOUND to false. Thus, the semaphore PACKET_FOUND may be used to determine whether radio/decoder 56 has successfully captured a data packet. Processing continues from blocks 208 and 210 to block 212 where processor 50 establishes a time reference by reading and storing a count value 92 from counter 82. In block 214, elapsed time since the last reading of counter 82 is calculated by subtracting the previous count value 92 from the current count value 92 and multiplying the result by the period of clock signal 64. The calculated elapsed time is added in block 216 to fractional register 40. In block 218 the calculated elapsed time is also added to the packet relative register 44.

Continuing to block 220, processor 50 references the current value of fractional register 40 and computes a delay period for programming timer 80 so as to achieve a next interrupt signal 90 at a time that will produce a given target value for fractional register 40 as a result of the next addition performed in block 218. Processor 50 then compares in decision block 222 the value held in register 40 against the value one.

If fractional register 40 holds a value greater than one, then in block 224 processor 50 updates display 16 using the current contents of time of day register 26. Then in block 226 processor 50 subtracts the value one from the fractional register 40 and adds the value one to the BCD register **32*b* of time of day register 26, i.e., to the register corresponding to the seconds units digit 22*b*. Also in block 228, as necessary, the time of day register 26 may be updated as a result of the change to register 32*b*, i.e., carry through tens of seconds, minutes units, tens of minutes, etc. Thus, it may be appreciated that execution time of block 228 is variable depending on the extent to which register 26 must be updated in light of the increment of BCD register 32*b*. Processing then continues to decision block 230**.

If it is determined in block 222 that fractional register 40 holds a value less than the value one, processing advances directly to decision block 230 skipping blocks 224–228.

In decision block 230 processor 50 tests the semaphore PACKET_FOUND. If PACKET_FOUND is true, processor 50 executes block 232 where, as explained in greater detail below, the packet relative register 44 is suitably initialized to account for offsets and delays. If PACKET_FOUND is false, processor 50 skips block 232. In either case, the interrupt routine illustrated in FIG. 7 concludes with execution of block 234 where any additional or other required tasks may be performed. The routine then returns to the interrupted task in block 236. Packet relative register 44 is properly initialized in block 232 only after a data packet is successfully captured, i.e., when semaphore PACKET_FOUND is set to true. The value to which packet relative register 44 is initialized is a constant value accounting for all offsets and delays relative to detection of a packet and resetting of registers 26 and 40. The first component of this constant is the target value for fractional register 40 used in block 220. In the preferred embodiment, the target value of register 40 is 1.02000 seconds. Another component is the length of a time slot to account for the fact that the actual time of day data held in the data packet corresponds the beginning of the time slot and the packet detect signal occurs at the end of the time slot. The final component is the execution time between the code point T, detection of a packet, and T5, update of display 16. Packet relative register 44 is set to the sum of these components in block 232.

Because the display 16 is updated in block 224 before the registers 26 and 40 are updated, in order to achieve a fixed execution time between both the packet detect and display update and the programmable timer interrupt and display update, the time of day held in registers 26 and 40 is actually set ahead of real time by a known amount. Furthermore, each time interrupt signal 94 occurs, the packet relative register 44 is advanced in block 218 by the elapsed time value calculated in block 214. Thus, the value maintained in packet relative register 44 accounts for the known discrepancy between the actual time and the time of day held in registers 26 and 40 such that the time on the display 16 matches the actual time of day.

Figure 8:
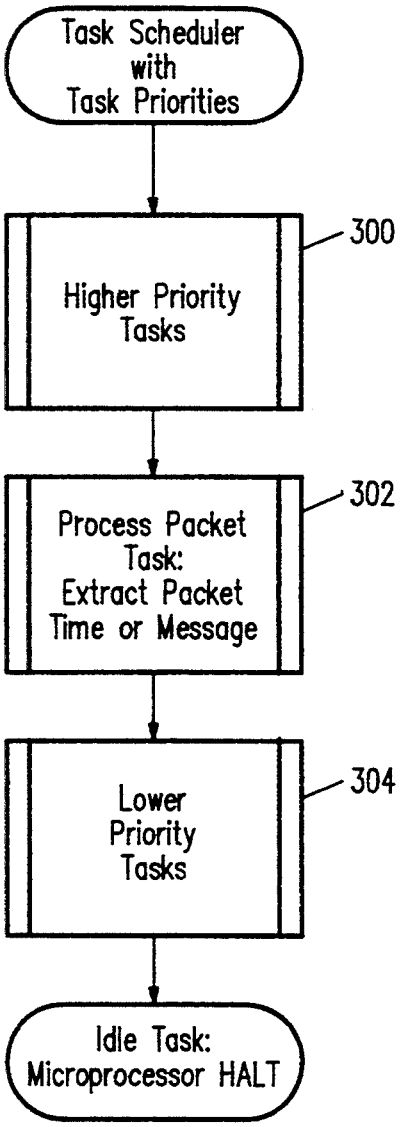
FIG. 8 is a flow chart of a real time operating system with task priorities for the wristwatches of FIG.1.

FIG. 8 is a flow chart of a real time operating system for each wristwatch 12. The operating system is a priority task scheduler which in block 300 executes high priority tasks, in block 302 processes data packets captured to obtain time of day data, and in block 304 executes lower priority tasks. The operating system shown in FIG. 8 may be interrupted by the interrupt procedure illustrated in FIG. 7.

Figure 9:
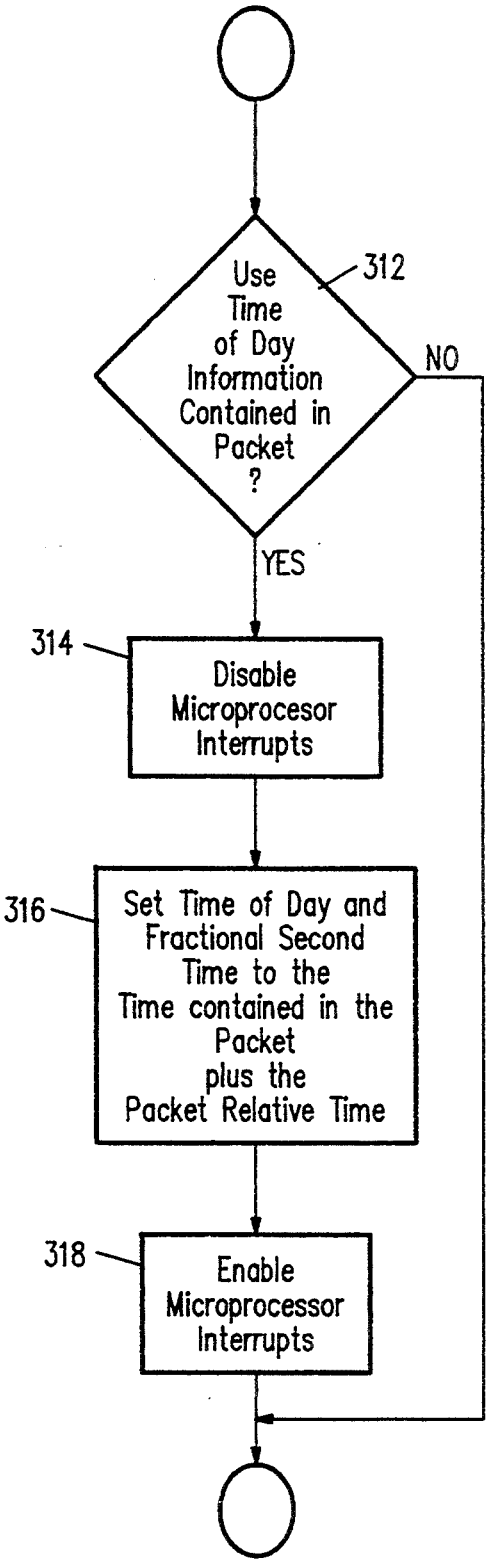
FIG. 9 is a flow chart of a procedure for setting the wristwatch time of day in response to time of day data obtained by radio signal.

FIG. 9 is a flow chart illustrating details of a portion of the data packet processing block 302. In FIG. 9, processor 50 determines in decision block 312 whether it needs to use the time of day data obtained from the captured data packet to reset registers 26 and 40. Processor 50 may be programmed to used such time of day data on a periodic basis, such as, for example, every hour or half hour. If processor 50 decides not to use the time of day data, it continues executing the remainder of block 302 (FIG. 8). If processor 50 decides to use the time of day data in the last captured data packet, processing branches from block 312 to block 314 where processor 50 disables interrupts. continuing to block 316, processor 50 resets registers 26 and 40 to hold a value corresponding to the time of day data found in the data packet plus the current contents of packet relative register 44. Interrupts are then enabled in block 308 and processor 50 continues executing the remainder of block 302 (FIG. 8).

Thus a method and apparatus for time maintenance and display has been shown and described. The described time keeping system 10 provides a plurality of time keeping devices, wristwatches 12, all displaying identical time of day, and changing synchronously from one time of day display to the next.

I claim:

1. A method for maintaining a time of day comprising: receiving a time of day value from an external source;

applying a clock signal of known frequency to a counter;

intermittently reading the contents of said counter;

calculating elapsed time between such intermittent readings of said counter by comparing a previous count to a current count;

adding said calculated elapsed time to a value stored in a fractional register and storing said sum in said fractional register;

comparing the sum in said fractional register to a given value and when said sum in said fractional register exceeds said given value subtracting from said sum in said fractional register said given value and adding to a time of day register said given value;

controlling a next said intermittent reading of said counter in response to the value stored in said fractional register, and updating the value in said time of day register with a value calculated from said received time of day, said elapsed time, and the time required to execute a fixed duration code sequence, whereby the contents of said time of day register indicates the time of day.

* * * * *